United States Patent [19]

Thatcher

[11] Patent Number: 4,533,907

[45] Date of Patent: Aug. 6, 1985

[54] SWIMMING POOL ALARM

[76] Inventor: John B. Thatcher, 4410 Hedge Court, Rohnert Park, Calif. 94928

[21] Appl. No.: 492,577

[22] Filed: May 9, 1983

[51] Int. Cl.[3] ..... G08B 21/00

[52] U.S. Cl. ..... 340/565; 310/324

[58] Field of Search ..... 340/565, 541, 573; 73/290 V; 181/233, 258; 138/110; 310/324

[56] References Cited

U.S. PATENT DOCUMENTS

| | | | |
|---|---|---|---|
| 3,461,446 | 10/1979 | Sergeant | 340/622 |
| 4,189,722 | 2/1980 | Lerner | 340/565 |
| 4,228,379 | 10/1980 | Guscott et al. | 310/324 X |

*Primary Examiner*—Glen R. Swann, III
*Assistant Examiner*—Jeffery A. Hofsass
*Attorney, Agent, or Firm*—Keith D. Beecher

[57] ABSTRACT

A swimming pool alarm in the form of an inexpensive compact unit which floats on the water in a swimming pool and which may be anchored to the side of the pool. The unit includes a hollow tubular probe which extends down below the surface of the water in the pool. The probe has an open bottom and a top closed by a flexible metal diaphragm. A piezoelectric ceramic member is attached to the upper surface of the diaphragm, and it serves to detect movements of the diaphragm in response to pressure changes in the air trapped in the upper portion of the probe. An electric circuit is connected to the piezoelectric ceramic member to activate and latch an electric alarm when the air pressure exceeds a predetermined threshold indicating, for example, that wave action in the pool has exceeded a predetermined level due to the fact that someone has fallen into the pool.

5 Claims, 6 Drawing Figures

SWIMMING POOL ALARM

BACKGROUND OF THE INVENTION

Recent years have shown an increase in the number of swimming pool installations, especially those in the back yards of homes. These pools present a safety hazard, especially in the case of small children who are unable to swim and who may play in the area adjacent to the pool. Regardless of the safety precautions that are maintained, instances still arise when play may go unsupervised and there always is a chance that a child may fall into the pool with the everpresent danger of being drowned.

The prior art swimming pool alarm systems have generally been of two types, namely, those having electrical contacts which are made or broken as a result of physical movement caused by surface wave action of the water in the pool, and those employing transducers. The present invention is of the second type.

One example of a transducer-type swimming pool alarm system is described in U.S. Pat. No. 4,187,502. As stated in that patent, representative of the electrical contact type of alarm systems may be found in U.S. Pat. Nos. 4,017,842; 3,778,803 and 3,504,145.

Another transducer system is described in U.S. Pat. No. 3,810,146 in which a transducer is mounted in the wall of a swimming pool and is responsive to ultrasonic signals from special transmitters which are worn by children, or others who might inadvertently fall into the pool. Such a system, however, is limited in that it would fail to detect an unequipped person.

In U.S. Pat. No. 3,969,712, a transducer is mounted on the underside of a floating housing. The housing contains circuitry to filter out lower frequency signals generated by the transducers, to integrate the signals and to activate an alarm when a particular threshold is reached. Such a system, however, is susceptible to surface wave action and requires that a relatively large area of the underside of the housing be sealed against water.

In accordance with the teachings of the present invention, a swimming pool alarm system is provided which overcomes the problems encountered in the prior art systems. The transducer type alarm system of the present invention is unresponsive to surface wave action and physical contact with objects such as wind blown debris, and physical contact with the sides of the pool. The system of the invention exhibits omnidirectional response to underwater pressure waves and detects with high accuracy the entrance of objects into the pool. The swimming pool alarm system of the present invention utilizes a piezoelectric element as the sensing transducer. The piezoelectric element produces a voltage in response to a change in stress applied thereto. A pair of electrodes are mounted on opposite sides of the transducer element for sensing the voltage. The transducer is provided with actuator means in the form of a diaphragm for transmitting pressure to the piezoelectric element to produce stress in the element so that upon an increase in pressure the piezoelectric element is stressed to produce a voltage which when it exceeds a predetermined threshold, activates an electric alarm.

DETAILED DESCRIPTION OF THE ILLUSTRATED EMBODIMENT

Figure 2:
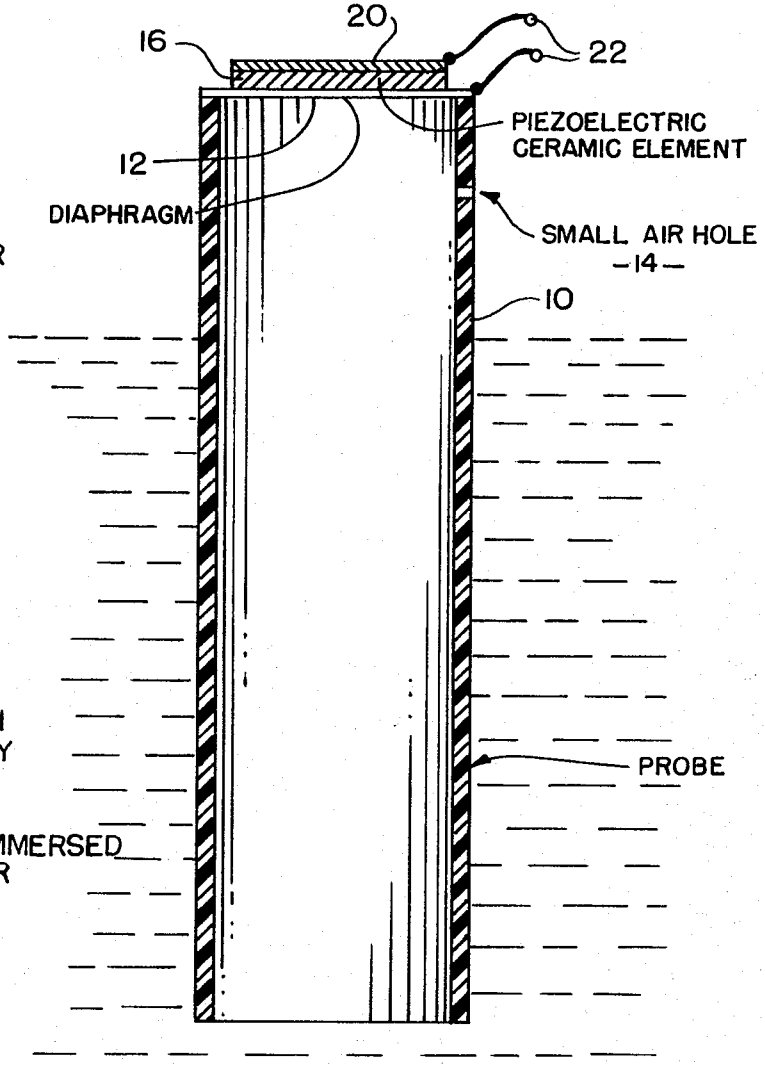
FIG. 2 is a side sectional view of an elongated hollow tubular probe which forms a component of the unit of FIG. 1.
Figure 1:
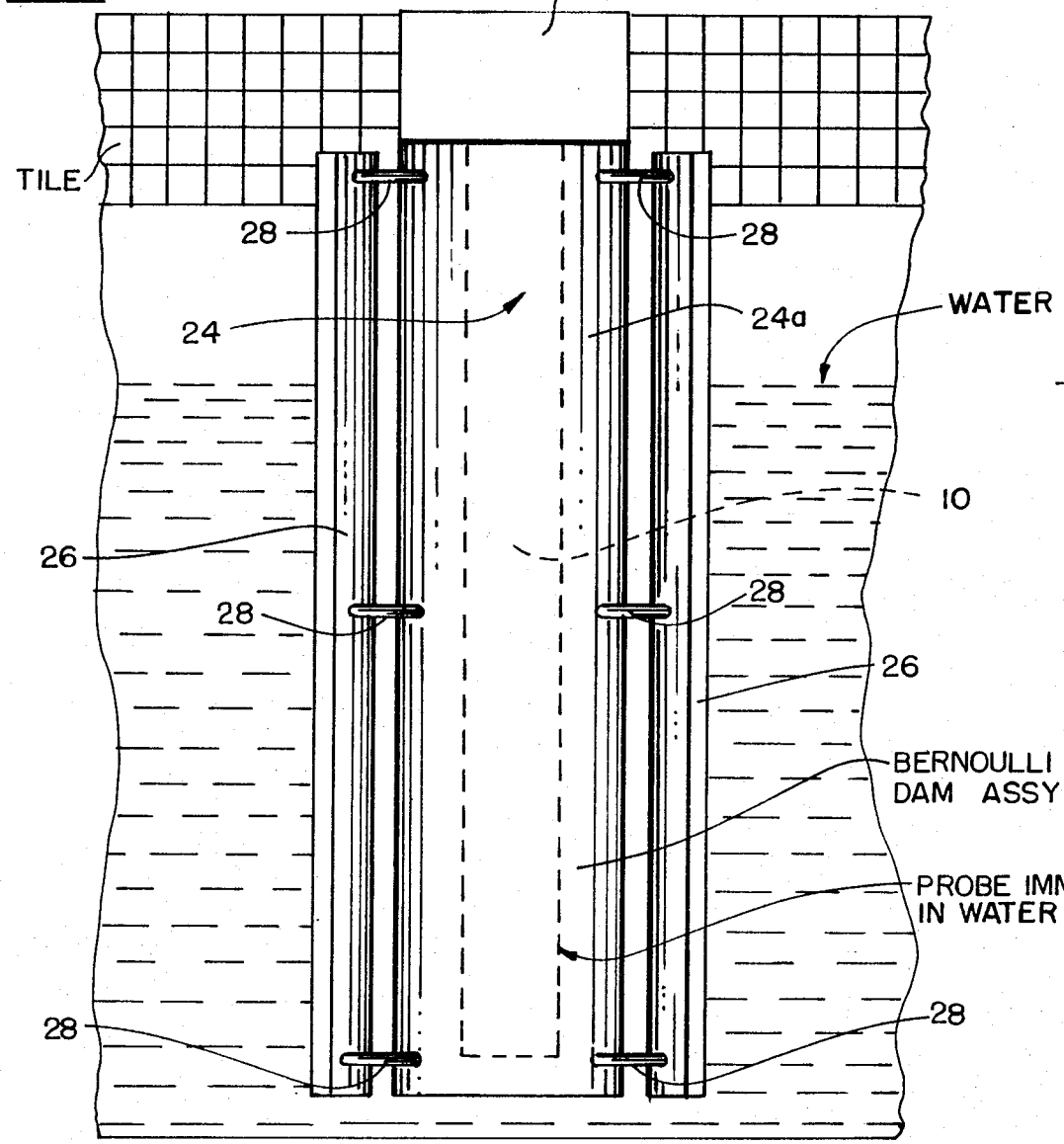
FIG. 1 is a somewhat schematic view of the swimming pool alarm system and unit of the invention floating on the water of a swimming pool, and anchored to the side of the pool.

Referring now to FIGS. 1–4, the alarm unit of the invention includes an internal elongated hollow tubular probe 10 which may be formed of plastic or metal. When the alarm unit is anchored to the side of a swimming pool, and floating on the water in the pool, such as shown in FIG. 1, the tubular probe 10 extends down into the water, as shown in FIG. 2. The probe 10 has an open bottom, and its top is closed by a flexible diaphragm 12 formed of an appropriate electrically conductive metal. When the probe is in position, as shown in FIG. 2, a quantity of air is trapped in the upper portion of the probe, and this air expands and contracts in response to underwater wave action caused, for example, should someone fall into the pool. A small air hole 14 is provided in the probe adjacent to its upper end. The probe may, for example, be of the order of 3.4 feet in length.

A piezoelectric ceramic element 16 is cemented or otherwise attached to the diaphragm 12, with the diaphragm serving as one of the electrodes for the element. A second electrode 20 is attached to the outer surface of the element. The electrode 20 and diaphragm 12 are connected to pair of output terminals 22, and a voltage appears across the output terminals. This voltage varies as the stress on element 16 changes which, in turn, is caused by movement of the flexible diaphragm 12, as the air trapped in the upper portion of the probe expands and contracts. Should someone fall into the pool, the resulting pressure wave within the water would cause an abrupt expansion and contraction of the air trapped within the probe creating a relatively large amplitude signal at the output terminals 22.

Figure 4:
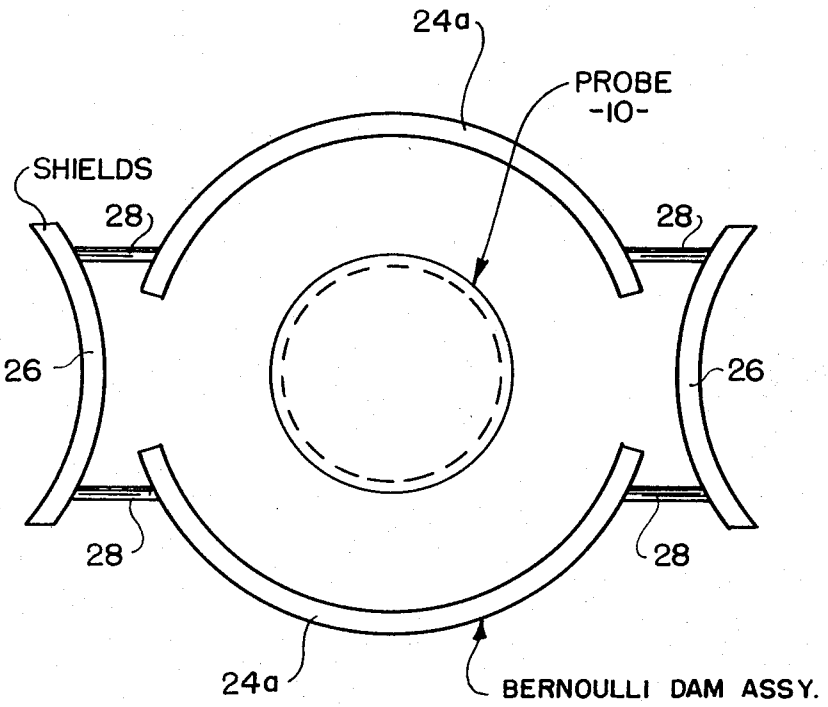
FIG. 4 is a top view of the dam assembly of FIG. 3, and showing the probe positioned within the assembly.
Figure 3:
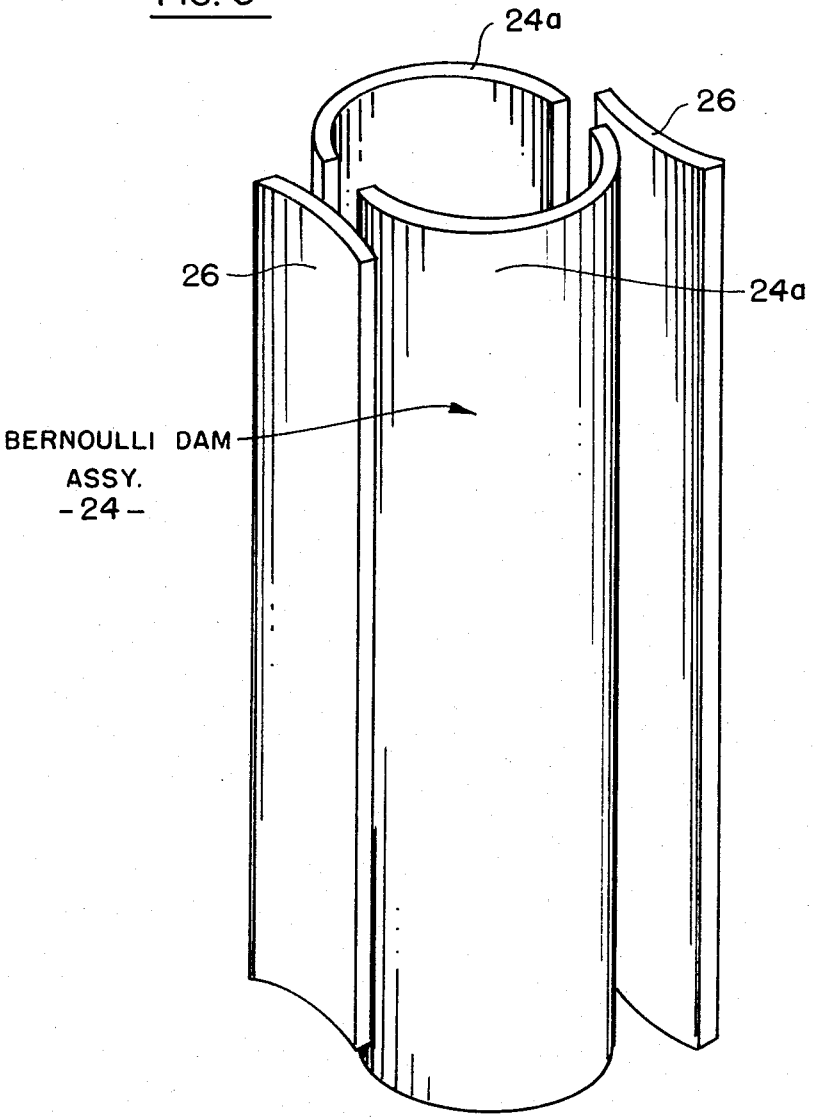
FIG. 3 is a perspective vlew of a Bernoulli dam assembly which surrounds the tubular probe of FIG. 2 when the unit is in the position shown in FIG. 1.

The probe 10 is mounted within an elongated Bernoulli dam assembly 24. This dam assembly, as best shown in FIGS. 3 and 4, comprises a pair of elongated arcuately shaped members 24A, and a pair of elongated arcuately shaped shields 26 which are affixed to the arcuate members 24A by brackets 28 (FIG. 4). A housing 30 (FIG. 1) is mounted on top of the unit, and this housing includes electronic circuitry and an alarm, as will be described in conjunction with FIGS. 5 and 6. The unit may include a local electrically activated alarm mounted within housing 30, or a transmitter may be provided to transmit the warning signal to a remote point at which the alarm is located The arcuate members 24A of the Bernoulli dam assembly of FIGS. 3 and 4 may, for example, be half-cylinders spaced from one another, as shown, with the shields 26 bridging the spaces, as best shown in FIG. 4.

The Bernoulli dam assembly prevents low pressure standing waves, and the like, within the pool water, caused, for example, by wind, pool sweepers, and the like, from setting off the alarm. This is achieved by preventing such waves from reaching the probe 10. Only water waves of sufficient amplitude to pass through the Bernoulli dam assembly are able to cause pressure fluctuation in the tubular probe causing a flex of the metal diaphragm 12 and resulting stress changes on the piezoelectric element 16. These stress changes produce voltage variations across the terminals 22 which are detected and used to activate the alarm.

Figure 5:
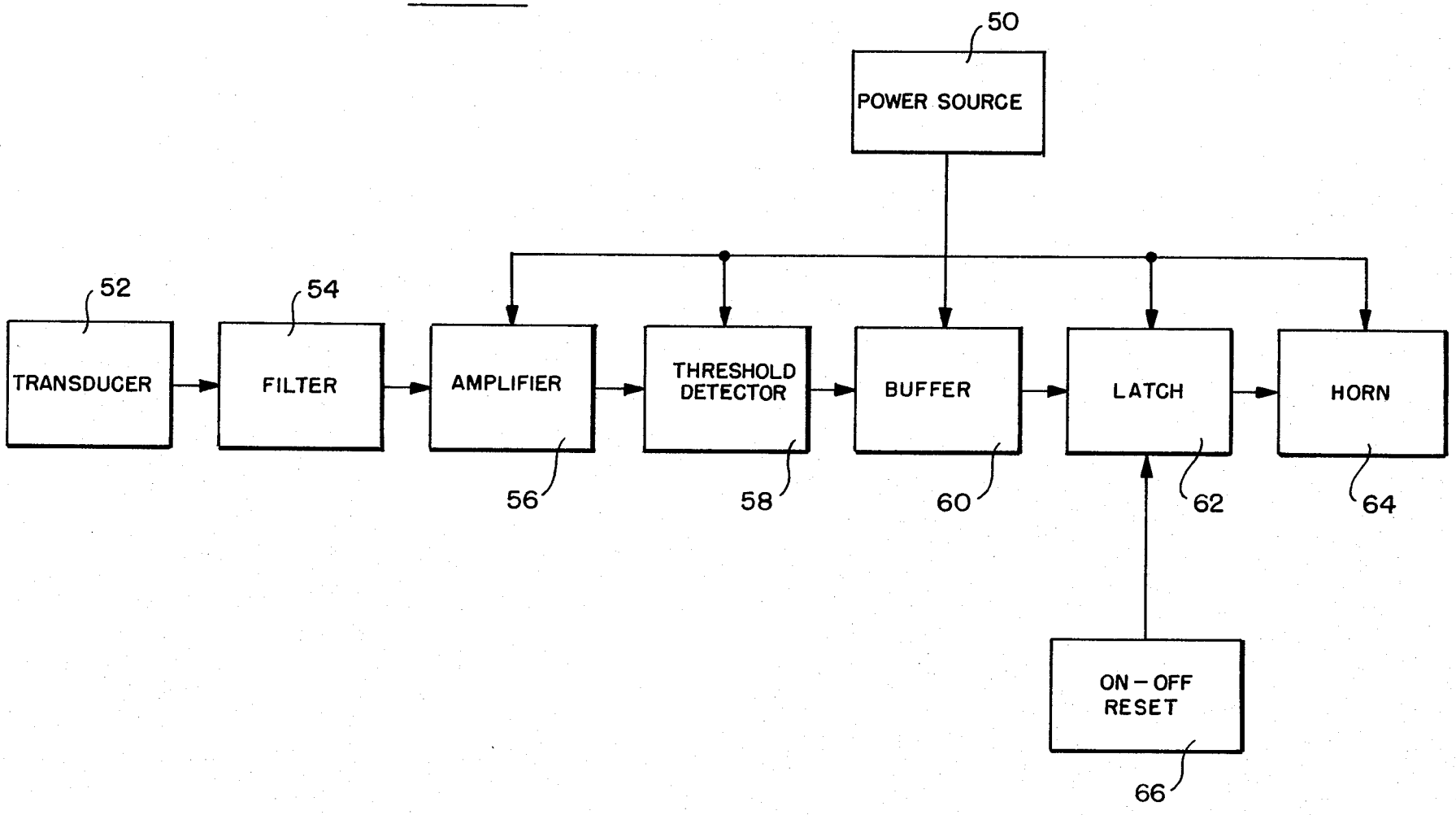
FIG. 5 is a block diagram of an electronic system included within the alarm system.

The electronic system located within the housing 30, as shown by the block diagram of FIG. 5 includes a power source 50. This power source may be a standard 9-volt alkaline battery. The alkaline battery is preferred over the carbon-sync battery due to its longer life and higher output over a wide range of temperatures. The particular battery may have a 0.5 amp/hour rating at 5.4 volts. The alarm circuit draws 11 microamps of current during standby operation, and 89 milliamps during the periods when the alarm is activated. The battery normally would last about three years without the need for replacement.

The transducer in the block diagram of FIG. 5 is represented by a block 52. This transducer, as described above, takes the form of a piezo ceramic element 16 mounted on a diaphragm 12 which may, for example, be a brass disc. The piezo ceramic element is used to convert the mechanical energy of the diaphragm into electrical energy. A 0.01 mil deflection of the diaphragm will cause the piezo ceramic element to produce approximately 1 volt across the output terminals 22.

Transducer 52 is connected to a filter 54 in the block diagram of FIG. 5. The filter may take the form of a 0.003 microfarad capacitor installed between the gate and drain electrodes of a field effect transistor, and a 9.1 megohm resistor connected from the gate to ground to provide an R-C low pass filter with a cut-off of approximately 5 Hz. The capacitor also reduces the danger of damage to the field effect transistor due to static discharge.

The field effect transistor forms an amplifier represented by block 56 in FIG. 5. The field effect transistor may be an N-channel J.F.E.T. This selection provides the lowest leakage current and offers a selection of devices which will operate at the micro-amp level.

The amplifier is connected to a threshold detector 58 which takes the form of a differential amplifier employing a low noise, high gain, low current, dual NPN transistor.

The threshold detector, in turn, is connected to a buffer 60 which has the form of a low noise, low current, high gain PNP transistor. Buffer 60 connects to a latch 62 which may be formed by a P.U.T. which is used as a latching relay. Any signal passed by the buffer to the latch above a particular threshold causes the latch to activate an electrically activated horn 64, and to hold the horn in its activated condition until the latch is reset manually by a reset circuit represented by block 66.

Figure 6:
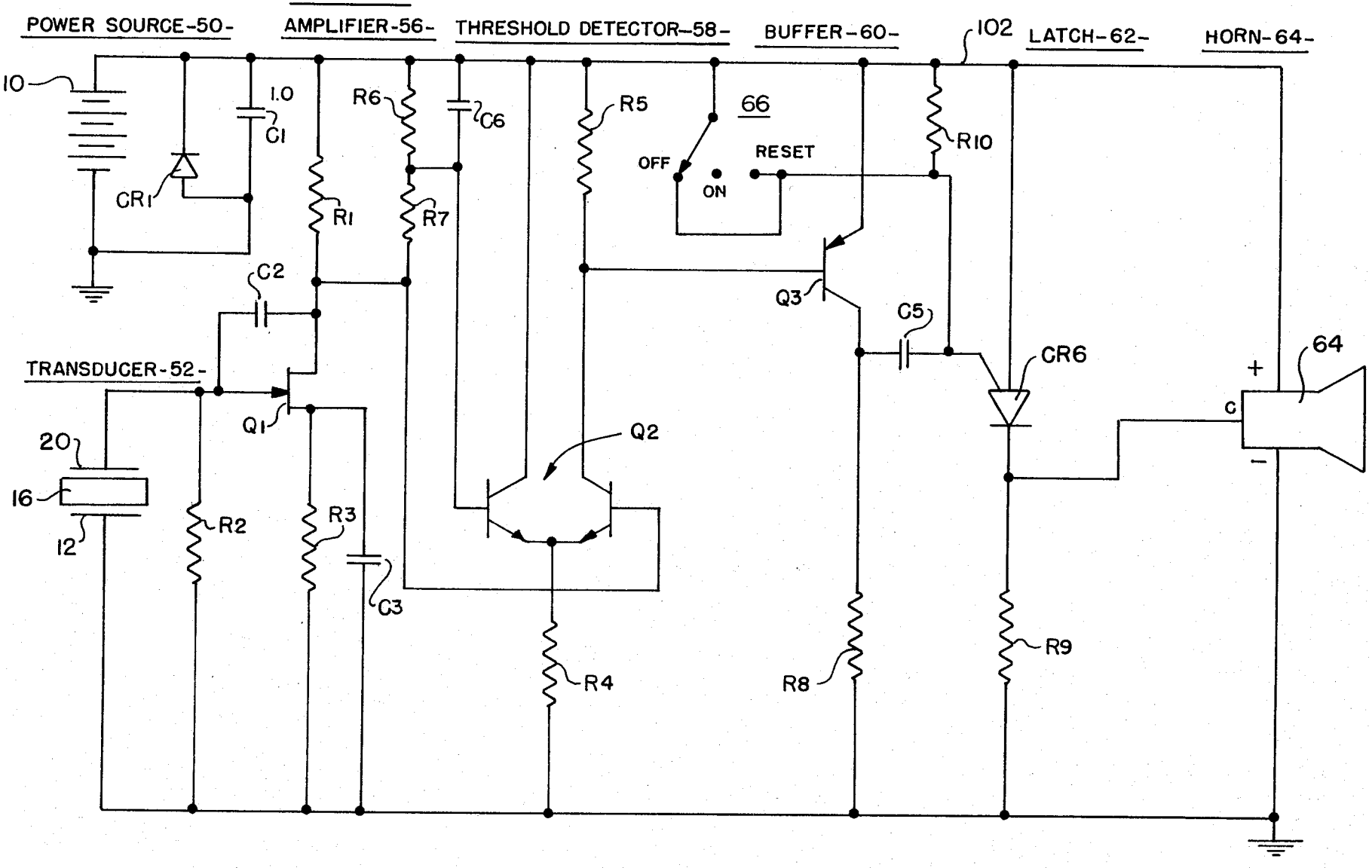
FIG. 6 is a circuit diagram of the system of FIG. 5.

As shown in the circuit diagram of FIG. 6, the battery of power source 50 is designated 100. The negative terminal of the battery is grounded, and the positive terminal is connected to a positive lead 102 which connects with one terminal of horn 64. The negative terminal of the battery is grounded. The battery is shunted by a diode CR1, and by a 1.0 microfarad capacitor C1. The diode is used for reverse voltage protection of the battery, and the capacitor is used for static protection when the battery is not in place. The amplifier 56 includes a field effect transistor (FET) Q1 which may be of the type designated 24117A.

A 0.003 microfarad capacitor C2 connected between the gate and collector of FET Q1, and a 1 megohm resistor R1 connected from the collector to lead 102, constitute the filter 54. The gate of FET Q1 is connected to a grounded 9.1 megohm resistor R2, and the collelctor is connected to a grounded 68 kilo-ohm resistor R3 and to a grounded 100 microfarad capacitor C3. The large source by-pass of the amplifier provides for high gain at low frequencies. The input impedance is approximately 9 megohms providing a good load for the transducer. The capacitor C2 connected between the gate and collector, in conjunction with resistor R2 from the gate to ground provides an R-C low pass filter (54) with a cut-off of approximately 5 Hz. Capacitor C2 also reduces the danger of damage to the FET due to static discharge.

A low noise, high gain, low current dual NPN transistor Q2 connected as a differential amplifier forms the threshold detector 58. The emitters of the dual transistor Q2 are connected to a grounded 1 megohm resistor R4, the collectors are connected respectively to lead 102 and through a 220 kilo-ohm resistor R5 to lead 102. The bases of the dual transistor Q2 are connected respectively to the junction of a 4.7 megohm resistor R6 and resistor R7, and to the drain of FET Q1. A 10 microfarad capacitor C6 is shunted across resistor R6. The collector of the second section of dual transistor Q2 is connected to the base of a PNP transistor Q3 which is connected as buffer 60. Transistor Q3 may be of the type designated 2N3965. The biasing voltage for the dual transistor Q2 in the threshold detector is derived from the first stage amplifier formed by FET Q1, with the threshold voltage being set by a resistive voltage divider formed by resistors R6 and R7. The current through the threshold detector is set by the 1 megohm emitter resistor R4.

As the first stage amplifier output changes the voltage on the base of the second section of dual transistor Q2, the voltage on the base of the first section remains unchanged due to the by-pass capacitor C6. A positive voltage from the amplifier 56 larger than the predetermined threshold causes the collector of the second section of transistor Q2 to change from the voltage of lead 102 (+VCC) to a voltage (+VCC−0.6) which is the voltage clamped by the base-emitter junction of transistor Q3 thereby rendering transistor Q3 conductive.

As illustrated in FIG. 6, the emitter of transistor Q3 is connected to lead 102, and the collector is connected to a grounded 1 megohm resistor R8. The collector of transistor Q3, which is normally at ground potential, will rise momentarily to approximately +VCC when the transistor is rendered conductive, and will then fall back to ground potential as the threshold detector restabilizes or when the wave causing the voltage passes.

A P.U.T. of the type designated 2N6027 and designated CR6 is used as a latch. The cathode of CR6 is connected to a 10 kilo-ohm grounded resistor R9, and the anode is directly connected to the lead 102. The collector of buffer transistor Q3 is coupled to the gate of CR6 through a 0.003 microfarad coupling capacitor C5, the gate being connected to the positive lead 102 through a 1 megohm resistor R10. The normal state of the P.U.T. is when the gate voltage is equal to or greater than the anode voltage so that no current flows from cathode to anode or cathode to gate.

When the buffer transistor Q3 is rendered momentarily conductive by action of the threshold detector 58, the coupling capacitor C5, which is normally charged to +VCC, discharges through the collector and emitter of buffer transistor Q3. When the buffer transistor Q3 is then rendered non-conductive, the gate voltage of CR6 drops and CR6 is rendered conductive. When CR6 is rendered conductive, a current flow through the gate resistor R10 causes a voltage drop which keeps CR6 conductive until the gate voltage is forced to +VCC (the voltage of lead 102) by actuation of the reset switch 66 which returns CR6 to its non-conductive state The horn 64 includes a low current transistor circuit. The current drain of the horn when activated is 80 milliamps, and the leakage current drain when the horn is de-activated is of the order of 1 microamp. The output of the particular horn is 85 db at 10 feet. The horn is activated when CR6 is rendered conductive by the resulting voltage drop across resistor R9.

As mentioned above, horn 64 may be located at a remote location, and a transmitter used in the circuit of FIG. 6 to transmit a coded signal to be decoded at a remote receiver so as to activate the horn.

In the circuit of FIG. 6, the transducer is activated by a pressure wave within the probe 10 of FIG. 2 to produce a momentary output voltage which is amplified by FET Q1. The dual transistor Q2 of the threshold detector responds to the resulting output of FET Q1 to render the buffer transistor momentarily conductive, only when the voltage is above a predetermined threshold, as established by resistors R6 and R7.

When the buffer transistor Q3 is momentarily rendered conductive, CR6 is fired, and becomes conductive to activate horn 64. CR6 remains conductive until de-activated by moving switch 66 from its "on" position to its reset position. When switch 66 is placed in its "off" position, the horn 64 is effectively turned off, and does not respond to any outputs from the threshold detector.

The invention provides, therefore, a compact and inexpensive swimming pool alarm unit which may be easily inserted into the water of a swimming pool and anchored to one side of the pool. The alarm unit is activated merely by setting the reset switch 66 in FIG. 6 to its "on" position. Any pressure wave within the probe 10 of FIG. 2 of sufficient intensity to indicate that someone has fallen into the pool causes the electronic circuit of FIG. 6 to activate the horn 64, and to latch automatically, so that the horn remains activated until switch 66 is moved to the reset position to turn off the horn, and is then moved back to its "on" position to reactivate the circuit.

It will be appreciated that while particular embodiments of the invention have been shown and described, modifications may be made. It is intended in the following claims to cover all modifications which come within the true spirit and scope of the invention.

What is claimed is:

1. A swimming pool alarm assembly including: a hollow elongated tubular probe adapted to be set in an upright position in the water of a swimming pool with its lower end extending below the surface of the water in the pool; a diaphragm mounted across the top of the probe to close the top; the tubular probe having an open bottom so that water rises in the probe to trap a quantity of air in the upper end thereof; a pressure responsive electrical transducer mounted on said diaphragm for generating voltages in response to stresses exerted on the transducer by movement of the diaphragm; an electrically activated alarm unit; electronic circuitry connected to said transducer and to said alarm unit to activate said alarm in response to voltages generated by said transducer; and a dam assembly surrounding said probe to shield said probe from surface waves of the water in the pool, and from waves of less than a predetermined threshold, said dam assembly comprising a pair of elongated arcuate-shaped members spaced apart, and positioned in coaxial relationship with said tubular probe, and a pair of elongated arcuate-shaped shields mounted on said first-named arcuate-shaped members respectively to bridge the space between said first-named arcuate-shaped members in spaced relationship therewith.

2. The swimming pool alarm assembly defined in claim 1, in which said electronic circuitry includes a threshold detector circuit to cause said alarm unit to be activated only by voltages exceeding a predetermined threshold amplitude.

3. The swimming pool alarm assembly defined in claim 1, in which said electronic circuitry includes a latching circuit for maintaining said alarm unit activated at the termination of an activating voltage; and a reset switch connected to said latching circuit for de-activating the alarm unit and for resetting the latching circuit.

4. The swimming pool alarm assembly defined in claim 1, in which said diaphragm is formed of an electrically conductive material, in which said transducer is in the form of a piezo ceramic element, and which includes an electrode mounted on the outer face of said element, and output terminals connecting the electrode and the diaphragm to said electronic circuit.

5. The swimming pool alarm assembly defined in claim 1, and which includes a vent hole in the upper portion of said tubular probe.

* * * * *